US007172414B2

(12) United States Patent
Von Blücher

(10) Patent No.: US 7,172,414 B2
(45) Date of Patent: Feb. 6, 2007

(54) ROTARY TUBULAR KILN FOR THE PRODUCTION OF ACTIVATED CARBON

(75) Inventor: Hasso Von Blücher, Erkrath (DE)

(73) Assignee: Blücher GmbH, Erkrath (DE)

( * ) Notice: Subject to any disclaimer, the term of this patent is extended or adjusted under 35 U.S.C. 154(b) by 17 days.

(21) Appl. No.: 11/176,032

(22) Filed: Jul. 7, 2005

(65) Prior Publication Data

US 2006/0269887 A1 Nov. 30, 2006

(30) Foreign Application Priority Data

Jul. 8, 2004 (DE) ..... 10 2004 033 233
Jul. 24, 2004 (DE) ..... 10 2004 036 109

(51) Int. Cl.
*F27B 7/16* (2006.01)

(52) U.S. Cl. ..... 432/118; 241/181

(58) Field of Classification Search ..... 432/118; 241/181, 183

See application file for complete search history.

(56) References Cited

U.S. PATENT DOCUMENTS 1,920,677 A * 8/1933 Burke ..... 206/219
2,939,693 A * 6/1960 Old et al. ..... 432/13
3,802,634 A * 4/1974 Mix ..... 241/183
4,569,659 A * 2/1986 Olsen et al. ..... 432/119
4,668,183 A * 5/1987 Patterson ..... 432/80
5,040,973 A * 8/1991 Matter et al. ..... 432/103
5,752,665 A * 5/1998 Wason ..... 241/299
6,705,859 B2 * 3/2004 McCarty ..... 432/118

FOREIGN PATENT DOCUMENTS

WO WO 01/83368 A1 11/2001

* cited by examiner

*Primary Examiner*—Gregory Wilson
(74) *Attorney, Agent, or Firm*—Woodard, Emhardt, Moriarty, McNett & Henry LLP

(57) ABSTRACT

The present invention relates to a rotary tube (1), in particular for a rotary tubular kiln for the production of activated carbon, said rotary tube (1) having a plurality of mixing elements (3), in particular metal turning plates, said mixing elements (3) being arranged in the interior (2) of the rotary tube (1) for circulating and/or mixing the charge material (4). The rotary tube (1) has apertures (5) for receiving securing sections (6) of the mixing elements (3), the securing sections (6) being welded to the outer side of the rotary tube (1). This prevents the welding location being exposed to the aggressive conditions in the interior (2) of the rotary tube (1) in the operating state during production of activated carbon, and it is readily possible for the welding location to be inspected from the outside, and for maintenance and repair to be carried out as necessary.

25 Claims, 3 Drawing Sheets

ROTARY TUBULAR KILN FOR THE PRODUCTION OF ACTIVATED CARBON

CROSS-REFERENCES TO RELATED APPLICATIONS

Applicant claims foreign priority benefits under 35 U.S.C. 119(a)–(d) of the following foreign applications for patent: German Patent Application No. DE 10 2004 033 233.9, filed Jul. 8, 2004, and German Patent Application No. DE 10 2004 036 109.6, filed Jul. 24, 2004, which are hereby incorporated by reference in their entirety.

BACKGROUND OF THE INVENTION

The present invention relates to a rotary tube, in particular for a rotary tubular kiln for the production of activated carbon, as disclosed herein and to a rotary tubular kiln comprising a rotary tube of this type. Furthermore, the present invention relates to the use of this rotary tube or rotary tubular kiln for the production of activated carbon. Finally, the present invention relates to a process of producing activated carbon using this rotary tube and this rotary tubular kiln, respectively.

On account of its highly non-specific adsorptive properties, activated carbon is the most widely used adsorbent. Statutory requirements as well as increasing environmental awareness are leading to an increasing demand for activated carbon.

The activated carbon is increasingly used in both the civil and military sectors. In the civil sector, the activated carbon is used, for example, for the purification of gases, filter installations for air conditioning, automobile filters etc., while in the military sector the activated carbon is used in all kinds of protective materials (e.g. breathing masks or gas-masks, protective covers as well as all kinds of items of protective clothing, such as for example protective suits etc.).

Activated carbon is generally obtained by carbonization (which is a synonym for "pyrolysis", "smouldering" or "coking") and subsequent activation of suitable carbon-containing starting materials. Carbonaceous starting materials which lead to economically viable yields are preferred, since the weight losses caused by the removal of volatile constituents during carbonization and caused by burn-off during activation are considerable. For further details as to the production of activated carbon, reference can be made, for example, to H. v. Kienle and E. Bäder, Aktivkohle und ihre industrielle Anwendung [Activated Carbon and its Industrial Use], Enke Verlag Stuttgart, 1980.

The condition of the activated carbon produced—finely porous or coarser porous, strong or brittle etc.—depends on the carbon-containing starting material. Examples of standard carbonaceous starting materials include coconut shells, wood waste, peat, hard coal, pitches, but also particular plastics, such as for example sulphonated polymers, which play a major role inter alia in the production of activated carbon in the form of small granules or spheres.

Various forms of activated carbon are used: powder coal, splint coal, granular coal, shaped coal and, since the end of the 1970s, also activated carbon in granule and sphere form (known as "granular carbon" or "spherical carbon"). Activated carbon in granule form, in particular in sphere form, has a number of advantages over other forms of activated carbon, such as powder coal, splint coal and the like, making it valuable or even indispensable for certain applications: it is free-flowing, hugely abrasion-resistant and dust-free and very hard. Granular coal, in particular spherical coal, is in very great demand for particular application areas, such as for example surface filter materials for protective suits providing protection against chemical toxins or filters for low pollutant concentrations in large quantities of air, on account of its specific form and also on account of its extremely high resistance to abrasion.

In most cases, suitable polymers are used as starting materials in the production of activated carbon, in particular granular carbon and spherical carbon. Sulphonated polymers, in particular sulphonated divinylbenzene-crosslinked styrene polymers, are preferably used, in which case the sulphonation can also be achieved in situ in the presence of sulphuric acid or oleum. Examples of suitable starting materials include ion-exchange resins or precursors thereof, which are generally divinylbenzene-crosslinked polystyrene resins; in the case of the finished ion-exchangers, the sulphonic acid groups are already present in the material, and in the case of the ion-exchanger precursors, the sulphonic acid groups are still to be introduced by sulphonation. The sulphonic acid groups have a crucial function, since they perform the role of a crosslinker by being cleaved off during the carbonization. However, the large quantities of sulphur dioxide released and the associated corrosion problems, inter alia, in the production equipment represent disadvantages and problems.

Activated carbon is usually produced in rotary tubular kilns (i.e. rotary tubular furnaces). These have, for example, a location for the raw material charge to be introduced at the start of the kiln and a location for the end product to be discharged at the end of the kiln.

In the conventional processes for producing activated carbon in accordance with the prior art, both the carbonization and the subsequent activation are carried out in a single rotary tube during discontinuous production.

During the carbonization, which may be preceded by a pre-carbonization phase, the carbon-containing starting material is converted into carbon, i.e. in other words the carbonaceous (i.e. carbon-containing) starting material is carbonized. During carbonization e.g. of the abovementioned organic polymers based on styrene and divinylbenzene, which contain crosslinking functional chemical groups which on thermal decomposition lead to free radicals and therefore to crosslinking, in particular sulphonic acid groups, the functional chemical groups, in particular sulphonic acid groups, are broken down—with volatile constituents, such as in particular $SO_2$, being released—and free radicals are formed, with a strong crosslinking action; without these free radicals, no pyrolysis residue (=carbon) would result. Suitable starting polymers of the abovementioned type include in particular ion-exchange resins (e.g. cationexchange resins or acidic ion-exchange resins, preferably comprising sulphonic acid groups, such as for example cation-exchange resins based on sulphonated styrene/divinylbenzene copolymers) or the precursors thereof (i.e. the unsulphonated ion-exchange resins, which have to be sulphonated before or during carbonization by a suitable sulphonating agent, such as for example sulphuric acid and/or oleum). The pyrolysis is generally carried out under an inert atmosphere (e.g. nitrogen) or at most a slightly oxidizing atmosphere. It may equally be advantageous to add a relatively small quantity of oxygen, in particular in the form of air (e.g. 1 to 5%) to the inert atmosphere during the carbonization, in particular at relatively high temperatures (e.g. in the range from approximately 500° C. to 650° C.), in order to oxidize the carbonized polymer skeleton and in this way to facilitate the subsequent activation.

On account of the acidic reaction products which are released during the carbonization (e.g. $SO_2$), this stage of the activated carbon production process is extremely corrosive with respect to the kiln or furnace material and imposes extremely high demands on the corrosion-resistance of the rotary tubular kiln material.

The carbonization is then followed by the activation of the carbonized starting material. The basic principle of the activation consists in some of the carbon generated during the carbonization being selectively and deliberately broken down or burnt off selectively under suitable conditions. This forms a large number of pores, gaps and cracks, and the mass-based specific surface area (in particular the BET area) of the activated carbon increases considerably. During the activation, therefore, carbon is burnt off in a selective and controlled way. Since carbon is broken down or burnt off during the activation, this operation leads to an in some cases considerable loss of substance, which under optimum conditions equates to an increase in the porosity and means an increase in the internal surface area (pore volume, BET) of the activated carbon. Consequently, the activation is carried out under selectively or controlled oxidizing conditions. Standard activation gases are generally oxygen, in particular in the form of air, and/or steam and/or carbon dioxide as well as mixtures of these activation gases. If appropriate, inert gases (e.g. nitrogen) may be added to the activation gases. To achieve a reaction rate which is sufficiently high for industrial purposes, the activation is generally carried out at relatively high temperatures, in particular in the temperature range from 700° C. to 1,200° C., preferably 800° C. to 1,100° C. This imposes high demands on the thermal stability of the rotary tubular kiln material.

Since the rotary tubular kiln material therefore, on the one hand, has to withstand the very corrosive conditions of the carbonization phase and also, on the other hand, the high-temperature conditions of the activation phase, only materials which have a good high-temperature corrosion resistance are used for the production of the rotary tubular kiln, i.e. in particular steels, which combine a good resistance to chemically aggressive materials, in particular a good corrosion resistance, and a good high-temperature stability in a single material. These are in particular high-alloy steels, i.e. steels comprising more than 5% of alloying elements. In particular, high-alloy chromium or chromium/nickel steels are used as materials for the production of appropriate rotary tubular kilns.

However, the high-temperature corrosion-resistance steels have the critical disadvantage of having only moderate to poor welding properties. This constitutes a problem because mixing elements in the form of paddle-like circulating or turning plates—also referred to synonymously as "material guide plates"—have to be present in the interior of the rotary tubular kiln for the purpose of intimately mixing the charge material, in particular homogeneously contacting the charge material with the activation gases, and these mixing elements likewise consist of high-temperature corrosion-resistant steel and have to be welded to the inner side of the inner walls of the rotary tube in order to stably bond them to the interior of the rotary tube. Embrittlement of the material may occur during welding of these high-temperature-resistant and corrosion-resistant steels with high chromium or chromium/nickel contents (e.g. as a result of precipitation phenomena and what is known as sigma phase formation). Moreover, grain growth which is likewise associated with embrittlement of the material may occur at temperatures of over 900° C. Therefore, the welding of the mixing or circulation elements to the inner walls of the rotary tube is not without problems in conventional production apparatus.

Furthermore, during the activated carbon production process, the welds or weld seams in the interior of the rotary tube are always exposed to high levels of stress, specifically on the one hand as a result of corrosive processes during carbonization and on the other hand as a result of the very high temperatures used during activation, so that high stress and demands are applied to the weld seams. This requires constant maintenance and inspection, which is not without problems, since the weld seams are arranged on the inner side, and consequently maintenance is only possible when the rotary tube is not operating.

To avoid the problems which have been outlined above, WO 01/83368 A1 proposes that the corrosive process stage of carbonization, which is associated with the release of acidic gases (e.g. $SO_2$), be separated from the high-temperature stage of post-carbonization and activation, i.e. that the corrosive phase of the carbonization be carried out in different equipment from the high-temperature phase of the post-carbonization and activation. Although this has the advantage that different rotary tube materials can be used for the corrosive phase of the carbonization, on the one hand, and the high-temperature phase of the post-carbonization and activation, on the other hand, with these materials respectively adapted to the corrosive phase and to the high-temperature phase, it has the associated disadvantage that carbonization and activation have to be carried out separately, i.e. cannot be carried out in a single piece of equipment in a single, discontinuous process.

Therefore, it is an object of the present invention to provide an apparatus which is suitable in particular for the production of activated carbon.

Therefore, a further object of the present invention is to provide a rotary tube and a rotary tubular kiln, in particular for the production of activated carbon, which at least partially avoids or at least palliates the disadvantages of the prior art which have been outlined above.

To solve the problem outlined above, the present invention proposes a rotary tube as disclosed herein. Further advantageous configurations and features of the present invention are also disclosed herein.

The present invention also relates to a rotary tubular kiln, which rotary tubular kiln comprises the rotary tube according to the present invention.

Furthermore, the present invention also relates to the use of the rotary tube and of the rotary tubular kiln according to the invention for the production of activated carbon.

Finally, the present invention relates to a process of producing activated carbon using the rotary tube and the rotary tubular kiln of the present invention, respectively.

Consequently, the subject-matter of the present invention—according to a first aspect of the present invention—is a rotary tube, in particular for a rotary tubular kiln for the production of activated carbon, having a plurality of mixing elements, said mixing elements being arranged in the interior of the rotary tube for circulating and/or mixing the charge material, in particular in the form of circulation or turning plates (also referred to synonymously as "material guide plates"), in which the rotary tube has apertures for receiving securing sections of the mixing elements, and the securing sections are welded to the outer side of the rotary tube. One particular feature of the present invention must therefore be considered to reside in the welding of the securing portions of the mixing elements to the outer side of the rotary tube.

The securing portions of the mixing elements are therefore fitted through the apertures in the rotary tube wall and welded to the outer side of the rotary tube. This in particular prevents the welding locations or weld seams being exposed to the aggressive conditions in the interior of the rotary tube in the operating state during production of activated carbon, i.e. corrosive gases during carbonization and high temperatures during activation. On account of the fact that the welding locations or weld seams are in this way exposed to a considerably reduced level of stress and demands, the service-life thereof is significantly increased. The welding to the outer side moreover significantly facilitates maintenance: the welding locations between mixing elements/rotary tube can readily be inspected from the outside and maintained and improved and repaired if necessary. Consequently, maintenance can be carried out even while the rotary tube is operating.

Moreover, it is in this way possible to use welding materials (also referred to synonymously as "weld materials" or "weld metal") which ensure an optimum and tight mixing element/rotary tube joint but would not otherwise be readily able to withstand the corrosive high-temperature conditions which prevail in the interior of the rotary tube during operating in the long term.

SUMMARY OF THE INVENTION

A rotary tube appropriate for a rotary tubular kiln for the production of activated carbon, according to one embodiment of the present invention comprises a plurality of mixing elements, each mixing element being arranged in the interior of the rotary tube for circulating and mixing a charge of material, wherein the rotary tube has apertures for receiving securing sections of the mixing elements and wherein the securing sections are welded to an outer side of the rotary tube.

Further advantages, properties, aspects, details and features of the present invention will emerge from the following description of a preferred exemplary embodiment illustrated in the drawings.

DETAILED DESCRIPTION OF THE INVENTION

Figure 1:
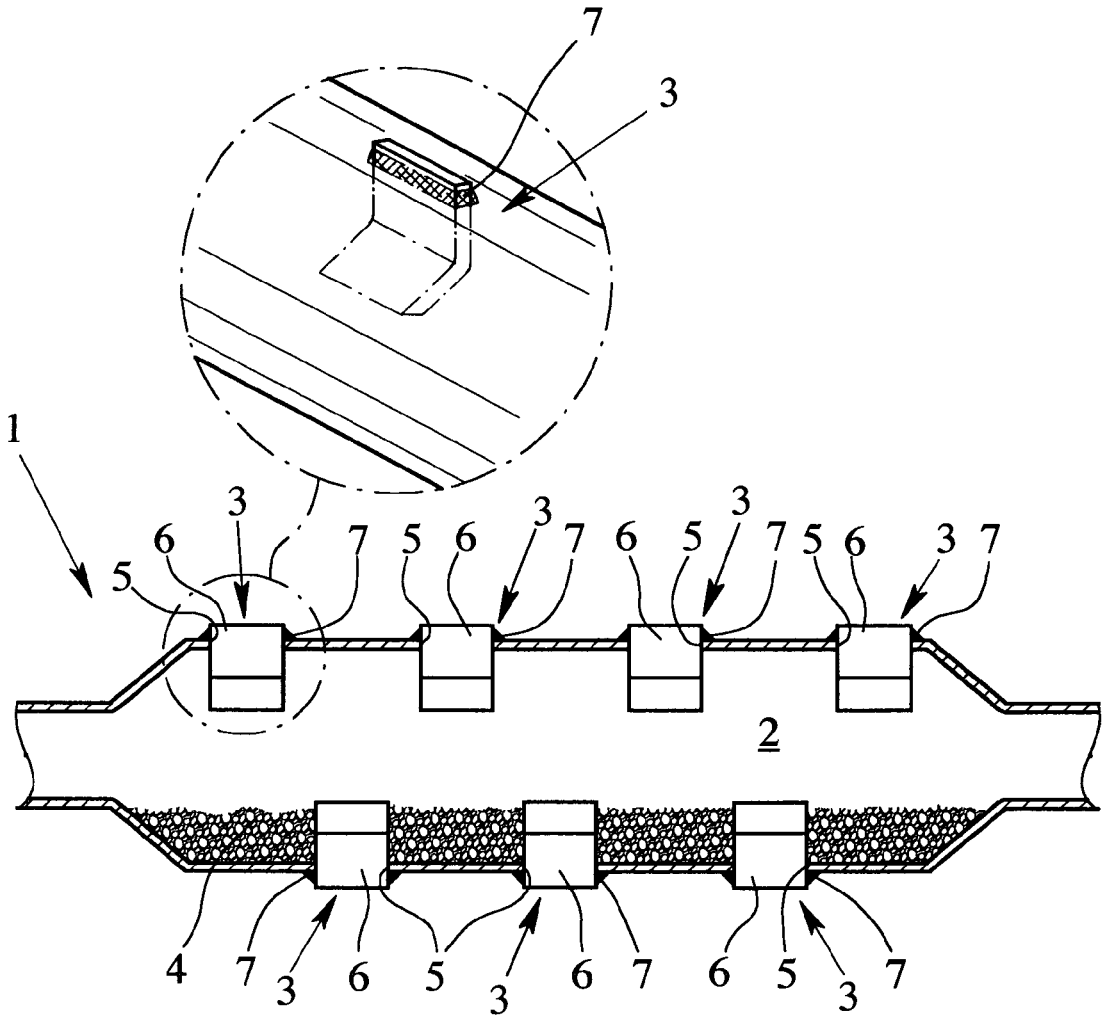
FIG. 1 shows a diagrammatic side-view of a rotary tubular kiln according to a preferred exemplary embodiment of the present invention in section.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2B:
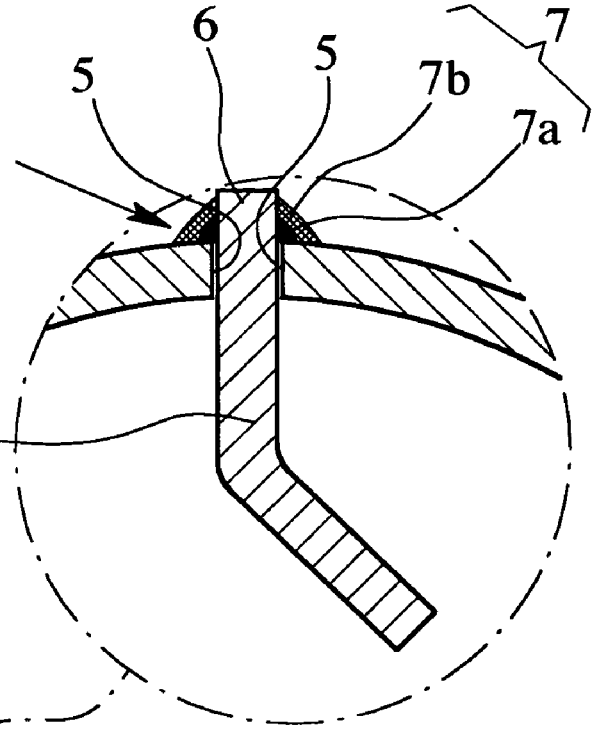
FIG. 2B shows an enlarged excerpt from the region indicated in FIG. 2A.
Figure 2A:
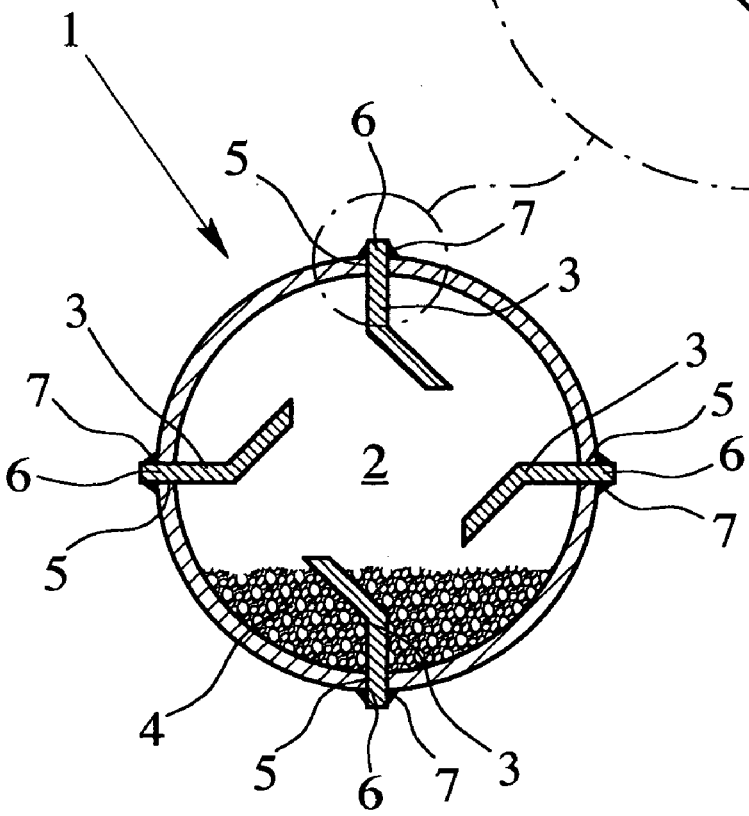
FIG. 2A shows a radial cross-section through the rotary tube.

FIGS. 1, 2A and 2B show a rotary tube 1 according to the present invention, which can be used in a rotary tubular kiln for the production of activated carbon. A plurality of mixing elements 3 for circulating and mixing the charge material 4 are arranged in the interior 2 of the rotary tube 1. These mixing elements 3 may, for example, be metal circulation plates or turning plates ("material guide plates"). The rotary tube 1 has apertures 5 which serve to receive securing portions 6 of the mixing elements 3. The securing portions 6 of the mixing elements 3 are welded to the outer side of the rotary tube 1.

The mixing elements 3 located in the interior 2 of the rotary tube 1 are advantageously distributed over the interior 3 of the rotary tube 1, so that optimum circulation and mixing of the charge material 4 is ensured in the operating state. The mixing elements 3 are permanently joined to the rotary tube 1 via their securing portions 6 welded to the outer side of the rotary tube 1. The securing portions 6 of the mixing elements 3 are fitted through the apertures 5 located in the wall of the rotary tube 1 and in particular protrude out of the wall of the rotary tube 1 a small amount on the outer side, so as to allow the securing portions 6 of the mixing elements 3 to be welded to the outer side of the rotary tube 1 (i.e. to the outer wall of the rotary tube 1).

As it has been outlined above, a number of advantages are associated with the welding being performed on the outer side of the rotary tube 1: firstly, the welding for the outer side prevents the welding location or weld seam being exposed to the aggressive conditions in the interior 2 of the rotary tube 1 in the operating state during production of activated carbon, i.e. corrosive acidic gases and high temperatures. Moreover, performing the welding on the outer side allows the welding to be inspected and maintained from the outside—even in the operating state—and to be repaired if necessary. Finally, it is in this way possible to use optimum weld materials, which ensure good and reliable permanent bonding between mixing elements 3 and rotary tube 1 but otherwise would not readily withstand the corrosive high-temperature conditions prevailing in the interior 2 of the rotary tube 1 in operation in the long term.

As it can be seen from FIG. 1 and in particular from FIGS. 2A and 2B, the securing portions 6 of the mixing elements 3 are welded to the outer side of the rotary tube 1 by way of a weld portion 7. This weld portion 7 advantageously includes at least two welding layers or two weld seams 7*a*, 7*b*. The two welding layers or weld seams 7*a*, 7*b* are advantageously arranged or applied above one another. This results in the formation of double welding layers or double weld seams 7*a*, 7*b*. This has the advantage that different materials can be used for the different welding layers 7*a*, 7*b*. By way of example, it is in this way possible for weld materials with different temperature- and corrosion-resistances to be used or combined with one another, in which case the inner welding layer 7*a* should advantageously be corrosion-resistant and high-temperature-resistant, whereas the same level of corrosion-resistance is not required of the outer welding layer 7*b*. The use of a plurality of welding layers or weld seams 7*a*, 7*b* results in tight, in particular gas-tight and reliable welding of the joining portions 6 of the mixing elements 3 to the rotary tube 1. According to a particular embodiment of the present invention, one of the two welding layers 7*a*, 7*b* is austenitic, in particular fully austenitic, in form, and the other is ferritic-austenitic in form. It is particularly preferable for the inner welding layer 7*a* to be austenitic, in particular fully austenitic, in form, and for the outer welding layer 7*b* to be ferritic-austenitic in form. According to a preferred embodiment, the welding is carried out by build-up welding (e.g. by electrode welding). In general, the welding is carried out in such a manner that the welding portion 7 is at least substantially gas-tight in form.

In general, the securing portions 6 of the mixing elements 3 are designed in such a manner that they project on the outer side. In other words, the securing portions 6 protrude beyond the outer wall of the rotary tube 1, allowing successful welding and secure anchoring of the securing portions 6.

The apertures 5 in the wall of the rotary tube 1, which serve to receive the securing portions 6 of the mixing elements 3, are generally designed in slotform. The securing portions 6 of the mixing elements 3 can then be fitted through these in particular slot-like apertures 5, advantageously in such a way that the securing portions 6 protrude, i.e. project a small amount from the outer surface of the rotary tube, so that they can be welded more successfully. This can be seen from FIGS. 2A and 2B.

Figures 3A, 3B, 3C:
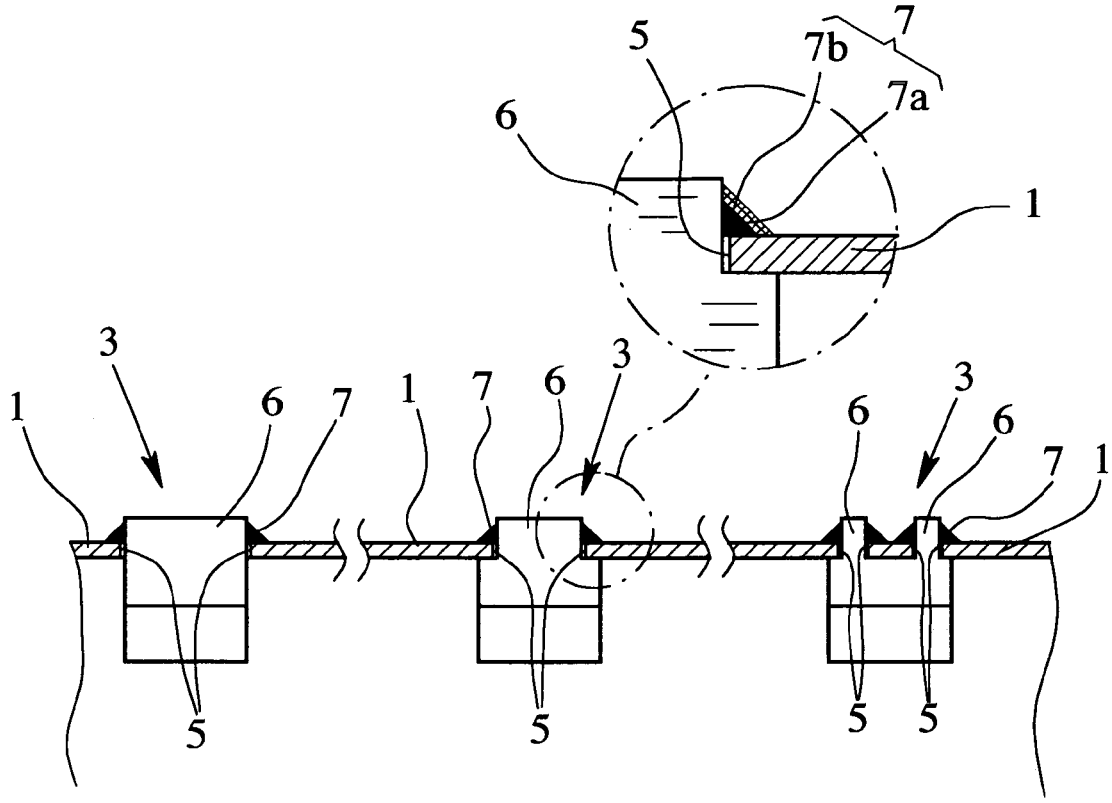
FIGS. 3A–C diagrammatically depict profiles of the mixing elements with different forms of securing portions.

Various configurations of the securing portions 6 of the mixing elements 3 are possible to ensure secure bonding of the securing portions 6 to the rotary tube 1: some of these are illustrated in FIGS. 3A to 3C. By way of example, it is possible for the securing portions 6 of the mixing elements 3 to extend over the entire bearing or peripheral length of the mixing elements 3; in this case, the securing portions 6 are fitted completely through the apertures 5 in the wall of the rotary tubular kiln 1, and an embodiment of this type is illustrated in FIG. 3A. Alternatively, it is possible for the securing portions 6 to be shorter than the bearing or peripheral length of the mixing elements 3; embodiments of this type are illustrated in FIG. 3B and FIG. 3C. In the latter cases, in accordance with FIGS. 3B and 3C, the mixing elements 3 may, for example, have a shoulder at the transition to the securing portion 6, which serves in particular to bear against the inner side or inner wall of the rotary tube 1. It is also possible for the mixing elements 3 in each case to have a plurality of securing portions 6 which engage in different apertures 5, as illustrated by way of example in FIG. 3C.

The mixing elements 3 may, for example, be configured in paddle-form or plate-form, in order to ensure reliable and intensive mixing and circulation of the charge material 4. According to one embodiment, the mixing elements 3 run at least substantially in the radial direction of the rotary tube 1, which ensures particularly intensive mixing of the charge material 4. The mixing elements 3 used may, for example, be metal sheets, in particular angled metal sheets (i.e. angled plates), which intimately mix the charge material 4 in the manner of a paddle. This is known per se to the person skilled in the art.

The rotary tube 1 and the mixing elements 3 advantageously consist of material which is resistant to high temperature and corrosion, in particular of steel, since both the rotary tube 1 and the mixing elements 3 have to withstand the extremely corrosive conditions of the carbonization phase as well as the high-temperature conditions of the activation phase during the production of activated carbon. Examples of suitable high-temperature-resistant and corrosion-resistant steels which can be used to produce the rotary tube 1 and/or the mixing elements 3 include high-alloy steels, i.e. steels containing more than 5% of alloying elements. Examples of such steels include high-alloy chromium and chromium/nickel steels, preferably with a chromium and/or nickel content of over 10%, in particular over 15%, particularly preferably over 20%, based on the alloy. Ferritic or ferritic-austenitic steels with good corrosion and high-temperature properties are preferably used as material for production of the rotary tube 1 and/or the mixing elements 3.

Moreover, the rotary tube 1 according to the invention advantageously has inlet and outlet devices for introducing and discharging gases and for allowing gases to pass through, for example for the introduction of inert gases for the carbonization phase during activated carbon production and for the introduction of oxidation gases for the activation phase during activated carbon production. This is not illustrated in the figures.

To allow improved maintenance of the interior of the rotary tube 1, the latter may have a manhole, as it is known, in the wall of the rotary tube; this manhole can be tightly sealed to the rotary tube 1 but allows maintenance staff to climb into the interior 2 of the rotary tube 1 when the latter is not operating. This is likewise not illustrated in the figures. This ensures maintenance also of the interior 2 of the rotary tube 1 in a simple way.

As it has already been described above, the rotary tube 1 according to the present invention is used in particular in rotary tubular kilns for the production of activated carbon. Therefore, another subject-matter of the present invention—according to a second aspect of the present invention—is a rotary tubular kiln which comprises the above-described rotary tube 1 according to the present invention.

A further subject-matter of the present invention—in accordance with a third aspect of the invention—is the use of a rotary tube 1 as described above or of a rotary tubular kiln including this rotary tube 1 for the production of activated carbon. As it has been described in the introduction to the present invention, activated carbon is generally produced by carbonization (which is synonymously also referred to as "pyrolysis", "smouldering" or "coking") and subsequent activation of carbon-containing (i.e. carbonaceous) starting materials, in particular organic polymers, such as for example sulphonated organic polymers (e.g. sulphonated divinylbenzene-crosslinked polystyrenes), which are carbonized and then activated in the rotary tube or rotary tubular kiln according to the present invention, respectively. The carbonization is generally carried out at temperatures of from 100° C. to 750° C., in particular 150° C. to 650° C., preferably 200° C. to 600° C., preferably under an inert or at most slightly oxidizing atmosphere, as described in the introduction. The carbonization may also be preceded by a pre-carbonization stage. By contrast, the activation is generally carried out at temperatures of from 700° C. to 1,200° C., in particular 800° C. to 1,100° C., preferably 850° C. to 1,000° C. As described in the introduction, the carbonization is generally carried out under controlled or selectively oxidizing conditions, in particular under a controlled oxidizing atmosphere. Suitable starting polymers of the type described above which can be mentioned include in particular ion-exchange resins (e.g. cation-exchange resins or acidic ion-exchange resins, preferably comprising sulphonic acid groups, such as for example cation-exchange resins based on sulphonated styrene/divinylbenzene copolymers) or precursors thereof (i.e. the unsulphonated ion-exchange resins, which still have to be sulphonated with a suitable sulphonating agent, such as for example sulphuric acid and/or oleum, before or during the carbonization). For further details in this respect, reference can be made to the statements made above in the introduction.

Finally, the present invention—according to another, fourth aspect of the present invention—also relates to a process of producing activated carbon, said process being performed in the inventive rotary tube or rotary tubular kiln, respectively. For further respective details, reference can be made to the above explanations.

The rotary tube or rotary tubular kiln according to the present invention makes it possible to produce activated carbon starting from suitable carbon-containing starting materials by carbonization and subsequent activation in a single apparatus with relatively easy operation. The welding of the mixing elements to the outer side provides a system which is easy to maintain, is relatively unsusceptible to the need to be repaired and is suitable for withstanding both the extremely corrosion conditions of the carbonization phase and the high-temperature conditions of the activation phase. The welding to the outer side makes it possible to use welding materials (="weld materials" or "weld metal") which are optimally suited to the welding but could not readily be used for welding to the inner side, since they would not readily withstand the corrosive high-temperature conditions in the interior of the rotary tubular kiln during operation in the long term.

Further advantages, configurations, modifications, variations and properties of the present invention will readily become clear and apparent to the person skilled in the art on reading the description, without the person skilled in the art leaving the scope of the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. Rotary tube appropriate for a rotary tubular kiln for the production of activated carbon, said rotary tube comprising:

a plurality of mixing elements, said mixing elements being arranged in the interior of the rotary tube for circulating and mixing the charge material;

wherein the rotary tube has apertures for receiving securing sections of the mixing elements;

wherein the securing sections are welded to the outer side of the rotary tube;

wherein the welding of the securing sections of the mixing elements to the outer side of the rotary tube is effected via a welding portion; and wherein the welding portion comprises at least two welding layers in the form of weld seams, wherein different materials are used for the various welding layers.

2. Rotary tube according to claim 1, wherein the securing portions of the mixing elements protrude on the outer side.

3. Rotary tube according to claim 1, wherein the apertures for receiving the securing portions of the mixing elements are of slot-like design.

4. Rotary tube according to claim 1, wherein the securing portions of the mixing elements are fitted through the apertures.

5. Rotary tube according to claim 1, wherein the rotary tube and the mixing elements consist of high-temperature-resistant and corrosion-resistant steel.

6. Rotary tube according to claim 1, wherein securing portions extend over the entire bearing or periphery length of the mixing elements.

7. Rotary tube according to claim 1, wherein securing portions are shorter than the bearing or peripheral length of the mixing elements.

8. Rotary tube according to claim 7, wherein the mixing elements have a shoulder at the transition to the securing portion for bearing against the inner side of the rotary tube.

9. Rotary tube according to claim 7, wherein the mixing elements each have a plurality of securing portions engaging in different apertures.

10. Rotary tube according to claim 1, wherein the mixing elements are metallic turning plates designed in paddle-form or plate-form.

11. Rotary tube according to claim 1, wherein the mixing elements run at least substantially in the radial direction of the rotary tube.

12. Rotary tube according claim 1, wherein the rotary tube further comprises inlet and outlet devices for introducing and discharging gases and allowing them to pass through.

13. Rotary tubular kiln appropriate for the production of activated carbon, which rotary tubular kiln comprises a rotary tube according to claim 1.

14. Process of producing activated carbon, wherein said process is performed in a rotary tube according to claim 1.

15. Process according to claim 14, wherein the activated carbon is produced by carbonization and subsequent activation of carbon-containing starting materials.

16. Process according to claim 15, wherein the carbonization is carried out at temperatures of from 100 to 750° C. under an inert or at most slightly oxidizing atmosphere.

17. Process according to claim 15, wherein the activation is carried out at temperatures of from 700 to 1,200° C. under a controlled oxidizing atmosphere.

18. Process according to claim 14, wherein sulphonated organic polymers as carbon-containing starting material are carbonized and then activated in the rotary tube.

19. Rotary tube according to claim 1, wherein the different weld materials have different temperature- and corrosion-resistances, the inner welding layer being corrosion-resistant and high-temperature-resistant.

20. Rotary tube according to claim 1, wherein one of the welding layers is austenic in form and the other is ferritic-austenic in form.

21. Rotary tube appropriate for a rotary tubular kiln for the production of activated carbon, said rotary tube comprising:

a plurality of mixing elements, said mixing elements being arranged in the interior of the rotary tube for circulating and mixing the charge material;

wherein the rotary tube has apertures for receiving securing sections of the mixing elements;

wherein the securing sections are welded to the outer side of the rotary tube;

wherein securing portions extend over the entire bearing or periphery length of the mixing elements; and wherein the mixing elements are permanently joined to the rotary tube only via their securing portions which are fitted through the apertures and welded to the outer side of the rotary tube.

22. Rotary tube appropriate for a rotary tubular kiln for the production of activated carbon, said rotary tube comprising:

a plurality of mixing elements, said mixing elements being arranged in the interior of the rotary tube for circulating and mixing the charge material;

wherein the rotary tube has apertures for receiving securing sections of the mixing elements;

wherein the securing sections are welded to the outer side of the rotary tube;

wherein securing portions are shorter than the bearing or peripheral length of the mixing elements;

wherein the mixing elements have a shoulder at the transition to the securing portion for bearing against the inner side of the rotary tube; and wherein the mixing elements are permanently joined to the rotary tube only via their securing portions which are fitted through the apertures and welded to the outer side of the rotary tube.

23. Rotary tube appropriate for a rotary tabular kiln for the production of activated carbon, said rotary tube comprising:

a plurality of mixing elements, said mixing elements being arranged in the interior of the rotary tube for circulating and mixing the charge material;

wherein the rotary tube has apertures for receiving securing sections of the mixing elements;

wherein the securing sections are welded to the outer side of the rotary tube;

wherein securing portions are shorter than the bearing or peripheral length of the mixing elements;

wherein the mixing elements each have a plurality of securing portions engaging in different apertures; and wherein the mixing elements are permanently joined to the rotary tube only via their securing portions which are fitted through the apertures and welded to the outer side of the rotary tube.

24. A process for producing activated carbon, wherein said process is performed in a rotary tube comprising:

a plurality of mixing elements, said mixing elements being arranged in the interior of the rotary tube for circulating and mixing the charge material;

wherein the rotary tube has apertures for receiving securing sections of the mixing elements;

wherein the securing sections are welded to the outer side of the rotary tube; and wherein the mixing elements are permanently joined to the rotary tube only via their securing portions which are fitted through the apertures and welded to the outer side of the rotary tube.

25. Rotary tube appropriate for a rotary tubular kiln for the production of activated carbon, said rotary tube comprising:

a plurality of mixing elements, said mixing elements being arranged in the interior of the rotary tube for circulating and mixing the charge material;

wherein the rotary tube has apertures for receiving securing sections of the mixing elements;

wherein the securing sections are welded to the outer side of the rotary tube; and wherein the mixing elements are permanently joined to the rotary tube only via their securing portions which are fitted through the apertures and welded to the outer side of the rotary tube.

* * * * *